US009933745B2

(12) United States Patent
Sasaki et al.

(10) Patent No.: US 9,933,745 B2
(45) Date of Patent: Apr. 3, 2018

(54) SOLID LUBRICANT, IMAGE FORMING APPARATUS AND IMAGE FORMING METHOD

(71) Applicant: Konica Minolta, Inc., Tokyo (JP)

(72) Inventors: Teruo Sasaki, Tokyo (JP); Yukio Hosoya, Tokyo (JP); Kunihiro Ogura, Tokyo (JP); Taiki Amemiya, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/227,033

(22) Filed: Aug. 3, 2016

(65) Prior Publication Data

US 2017/0052501 A1 Feb. 23, 2017

(30) Foreign Application Priority Data

Aug. 19, 2015 (JP) ..... 2015-161759

(51) Int. Cl.

*G03G 21/00* (2006.01)
*C10M 169/04* (2006.01)
*C10M 111/04* (2006.01)

(52) U.S. Cl.

CPC ..... *G03G 21/00* (2013.01); *C10M 111/04* (2013.01); *C10M 169/041* (2013.01); *G03G 21/0094* (2013.01); *C10M 2205/022* (2013.01); *C10M 2205/0225* (2013.01); *C10M 2205/12* (2013.01); *C10M 2205/123* (2013.01); *C10M 2207/126* (2013.01); *C10M 2207/1253* (2013.01); *C10N 2210/02* (2013.01); *C10N 2220/02* (2013.01); *C10N 2250/08* (2013.01)

(58) Field of Classification Search

CPC ..... G03G 21/00; G03G 21/0094; C10M 169/041; C10M 2205/022; C10M 2205/2207; C10M 2205/126; C10N 2250/08

USPC ..... 399/346; 430/126.6

See application file for complete search history.

(56) References Cited

U.S. PATENT DOCUMENTS 3,476,532 A * 11/1969 Hartman ..... C08K 3/16 427/393.4
2003/0049555 A1 3/2003 Sakon
2007/0026330 A1* 2/2007 Wu ..... G03G 5/043 430/58.05

(Continued)

FOREIGN PATENT DOCUMENTS

CN 101914250 A * 12/2010
CN 103254363 A * 8/2013

(Continued)

OTHER PUBLICATIONS

Notice of Reasons for Rejection dated Jun. 20, 2017 from corresponding Japanese Patent Application No. JP 2015-161759 and English translation.

*Primary Examiner* — Robert Beatty
(74) *Attorney, Agent, or Firm* — Lucas & Mercanti, LLP

(57) ABSTRACT

A solid lubricant containing a fatty acid metal salt and a polyethylene having an acid value is prepared. The solid lubricant is disposed so as to be applied on a surface of an image bearing member of an image forming apparatus in electrophotography, and a lubricant layer is formed on the surface of the image bearing member with the solid lubricant.

8 Claims, 3 Drawing Sheets

(56) References Cited

U.S. PATENT DOCUMENTS

| | | | | |
|---|---|---|---|---|
| 2008/0099730 | A1* | 5/2008 | Sim | B29C 47/94<br>252/400.21 |
| 2009/0156722 | A1* | 6/2009 | Khanna | C08L 27/06<br>524/230 |
| 2012/0107739 | A1* | 5/2012 | Yamashita | G03G 9/0819<br>430/119.82 |

FOREIGN PATENT DOCUMENTS

| | | | | |
|---|---|---|---|---|
| CN | 103509361 | A | * | 1/2014 |
| JP | 63248877 | A | * | 10/1988 |
| JP | 02009630 | A | * | 1/1990 |
| JP | 09197711 | A | * | 7/1997 |
| JP | 10260546 | A | * | 9/1998 |
| JP | 2000314983 | A | * | 11/2000 |
| JP | 2002-341578 | A | | 11/2002 |
| JP | 2003231808 | A | * | 8/2003 |
| JP | 2005179392 | A | * | 7/2005 |
| JP | 2006220819 | A | | 8/2006 |
| JP | 2009109950 | A | | 5/2009 |

* cited by examiner

SOLID LUBRICANT, IMAGE FORMING APPARATUS AND IMAGE FORMING METHOD

CROSS REFERENCE TO RELATED APPLICATIONS

This application is entitled to and claims the benefit of Japanese Patent Application No. 2015-161759, filed on Aug. 19, 2015, the disclosure of which including the specification, drawings and abstract is incorporated herein by reference in its entirety.

BACKGROUND OF THE INVENTION

1. Field of the Invention

The present invention relates to a solid lubricant, an image forming apparatus, and an image forming method.

2. Description of Related Art

In electrophotographic image forming apparatuses, a technology in which a solid lubricant comprising a wax and a metal soap (fatty acid metal salt) is applied on the surface of an image bearing member (photoconductor) from the standpoint of suppressing abrasion of the surface of the image bearing member and a cleaning blade for cleaning the surface of the image bearing member is known (see, for example, Japanese Patent Application Laid-Open Nos. 2006-220819 and 2009-109950).

The technology is effective to suppress image density unevenness in an image formed (especially half-tone image in intermediate density area) as compared with the case where the metal soap is used alone as a lubricant. In the technology, however, the applicability of the lubricant to the image bearing member is insufficient in some cases, causing application failure or application unevenness of the lubricant on the image bearing member. Thus, the abrasion of the cleaning blade is accelerated, resulting in the occurrence of cleaning failure in some cases.

SUMMARY OF THE INVENTION

The first object of the present invention is to provide a solid lubricant that is capable of suppressing the occurrence of image density unevenness and cleaning failure in electrophotographic formation of an image.

The second object of the present invention is to provide an electrophotographic image forming apparatus and an image forming method each suppressing the occurrence of image density unevenness and cleaning failure.

To achieve the first object, a solid lubricant reflecting one aspect of the present invention is a solid lubricant for forming a lubricant layer on a surface of an image bearing member of an image forming apparatus in electrophotography by being applied on the surface of the image bearing member, the solid lubricant comprising: a fatty acid metal salt; and a polyethylene having an acid value.

To achieve the second object, an image forming apparatus reflecting one aspect of the present invention comprises: a rotatable image bearing member; a charging device for charging the image bearing member; a transfer device for transferring a toner image born on the charged image bearing member to a toner receiving article; and a lubricant applying device for applying a lubricant on a surface of the image bearing member, the lubricant applying device being disposed between the transfer device and the charging device in a rotational direction of the image bearing member, in which the lubricant applying device comprises: the solid lubricant described above; a lubricant applying member that has flexibility and is to be disposed so as to abut freely on the surface of the image bearing member; and a lubricant supplying device for supplying the solid lubricant to the lubricant applying member.

To achieve the second object, an image forming method reflecting another aspect of the present invention comprises: charging an image bearing member; forming an electrostatic latent image on a charged image bearing member; supplying a toner onto the image bearing member having an electrostatic latent image formed thereon, thereby allowing to bear the toner image on the image bearing member; transferring the toner image born on the image bearing member to a toner receiving article; and applying, on the surface of the image bearing member after transferring the toner image, a lubricant supplied from a solid lubricant, thereby forming a lubricant layer, in which the solid lubricant according to claim 1 is used as the solid lubricant.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1:
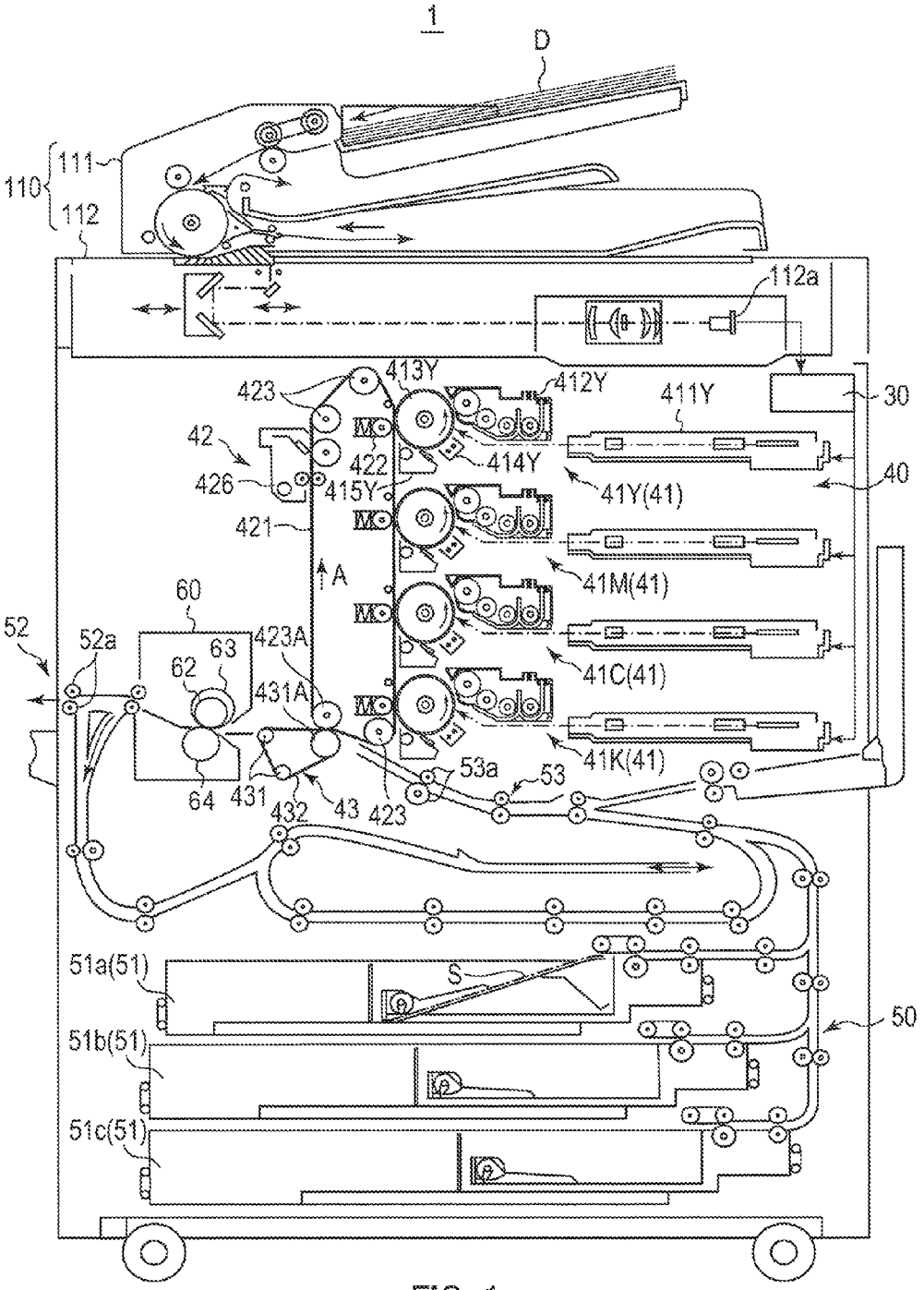
FIG. 1 is a diagram schematically illustrating a configuration of an image forming apparatus in an embodiment of the present invention.

Hereinbelow, embodiments of the present invention will be described.

[Solid Lubricant]

The solid lubricant according to the embodiments of the present invention is a solid lubricant for forming a lubricant layer on a surface of an image bearing member of an image forming apparatus in electrophotography by being applied on the surface of the image bearing member, and comprises: a fatty acid metal salt; and a polyethylene having an acid value (hereinbelow, also referred to as "acid value polyethylene").

As the fatty acid metal salt, publicly known fatty acid metal salts (metal soaps) that can be used as a lubricant in electrophotographic image forming apparatuses can be used. The fatty acid metal salts may be used alone or in combination of two or more. The fatty acid metal salt is a metal salt of a fatty acid and is obtained by, for example, neutralization of a fatty acid with an alkaline compound comprising the metal.

It is preferable that the number of carbon atoms of the fatty acid is 10 to 30, more preferably 12 to 28 from the standpoint of compatibility with the acid value polyethylene and the standpoint of spreadability of the solid lubricant. Examples of the fatty acid include stearic acid, palmitic acid, myristic acid, lauric acid, oleic acid, and behenic acid. Moreover, examples of the metal include zinc, magnesium, calcium, barium, and lithium.

It is preferable that the melting point of the fatty acid metal salt is 70 to 250° C., more preferably 100 to 160° C. from the standpoint of compatibility with the acid value polyethylene during melt molding. It is more preferable that the fatty acid metal salt is zinc stearate among others from the standpoint of excellent spreadability and the standpoint of advantage in melt molding because of a small difference in melting point of zinc stearate and the acid value polyethylene.

The acid value polyethylene has an acid value. The acid value of the acid value polyethylene is larger than 0 mgKOH/g and can appropriately be determined within a range where the effect is obtained. When the acid value is too low, the affinity of the solid lubricant to the image bearing member is insufficient and the effect cannot be obtained sufficiently in some cases. When the acid value is too high, the melt viscosity of the acid value polyethylene is too high and, in the case where the acid value polyethylene is mixed with the fatty acid metal salt, moldability is insufficient or applicability to the image bearing member is insufficient in some cases. Thus, it is preferable that the acid value is 1 mgKOH/g or more, more preferably 1 to 80 mgKOH/g, further more preferably 3 to 50 mgKOH/g from the standpoint of exhibiting the effect, the moldability, and the applicability sufficiently.

The acid value is the number of mg of KOH needed to neutralize an acid component in 1 g of the acid value polyethylene. The acid value can be determined by a test method specified in JIS K0070. The acid value can be adjusted by the amount of acidic groups introduced to the acid value polyethylene or by mixing acid value polyethylenes each having a different acid value.

Examples of the acid value polyethylene include oxidized polyethylenes and polyethylenes having an acidic group.

The oxidized polyethylene is obtained by directly oxidizing polyethylene. The oxidized polyethylene can be produced by a publicly known method and by the methods described in, for example, Japanese Patent Application Laid-Open Nos. 2004-75749, 11-80252, 10-279624, 04-328108, and 01-022905, and Japanese Unexamined Patent Application Publication (Translation of PCT Application) No. 2010-515819.

Examples of the acidic group in the polyethylene having an acidic group include a carboxyl group and a carboxylic acid anhydride group. The acidic groups may be used alone or in combination of two or more. The polyethylene having the acidic group can be prepared with a copolymer of ethylene and an acidic monomer having the acidic group. Examples of the polyethylene having the acidic group include copolymerized polyethylenes obtained by copolymerizing an unsaturated carboxylic acid and ethylene and copolymerized polyethylenes obtained by copolymerizing an unsaturated carboxylic acid anhydride and ethylene. The acidic monomer is a compound having a carbon-carbon double bond and the acidic group, such as a compound having a (meth)acryloyl group, and examples thereof include maleic acid, acrylic acid, maleic anhydride, and methacrylic acid.

The polyethylene having the acidic group can be produced by a publicly known method, and examples thereof include methods described in Japanese Patent Application Laid-Open Nos. 2014-198847, 2011-162797, 2003-252927, and 2000-26490, and Japanese Unexamined Patent Application Publication (Translation of PCT Application) No. 9-506658.

It is preferable that the weight average molecular weight of the acid value polyethylene is 500 to 15,000. When the weight average molecular weight is more than 15,000, the spreadability to the image bearing member is lowered and the applicability is insufficient in some cases. When the weight average molecular weight is less than 500, the acid value polyethylene acts as a plasticizer in the solid lubricant because the molecular weight is too low, and it becomes difficult to set the conditions of supplying the solid lubricant to the image bearing member (for example, conditions for scraping the solid lubricant to produce fine particles), resulting in reduction of the effect in some cases. It is more preferable that the weight average molecular weight is 1,000 to 10,000 from the standpoint of sufficient exhibition of the effect and of improvement in the applicability.

When the melting point of the acid value polyethylene is too low, there is a tendency that the acid value polyethylene acts as a plasticizer in the solid lubricant, and when the melting point of the acid value polyethylene is too high, there is a tendency that the applicability to the image bearing member is lowered. Thus, it is preferable that the melting point is 90 to 160° C., more preferably 100 to 150° C., further more preferably 110 to 150° C.

The acid value polyethylene may be produced by publicly known methods mentioned previously or a commercial product corresponding to the intended polyethylene may be used as it is. Examples of the commercial product include Hi-WAX 210MP, 220MP, 310MP, 320MP, 405MP, 4051E, 4052E, 4202E, 4252E, 1105A, 2203A, and 3202A (all manufactured by Mitsui Chemicals, Inc.), A-C 673P, A-C 680, A-C 655, A-C 629, A-C 656, A-C 307, A-C 316, A-C 325, A-C 392, A-C 330, A-C 395, A-C 540, A-C 573A, A-C 575A, and ACumist A series (all manufactured by Honeywell Japan Inc.), and Licolub H 12, Licowax PED 521, Licowax PED 522, Licowax PED 121, Licowax PED 153, Licowax PED 191, Licowax PED 192, and Ceridust 3715 (all manufactured by Clariant (Japan) K.K.).

It is preferable that the content ratio A/M of the acid value polyethylene A to the fatty acid metal salt M in the solid lubricant by mass is 1/99 to 30/70. When the content ratio is less than 1/99, the action of the acid value polyethylene is too small, and therefore the affinity with the image bearing member is reduced and the effect is also reduced in some cases. When the content ratio exceeds 30/70, the spreadability of the solid lubricant with a cleaning blade is reduced and the effect is reduced in some cases. It is more preferable that the content ratio is 2/98 to 20/80, further more preferably 3/97 to 15/85 from the standpoint of the affinity and the spreadability. The content ratio can be specified using a publicly known analysis method, such as nuclear magnetic resonance or Fourier transform infrared spectroscopy.

The solid lubricant may further comprise another component other than the fatty acid metal salt and the acid value polyethylene within a range where the effect according to the present embodiments is obtained.

The solid lubricant is obtained by melting and mixing the fatty acid metal salt and the acid value polyethylene, and then solidifying the resultant mixture in a desired shape by cooling. For example, the solid lubricant can be produced by a melt molding method in which a mixed molten solution of the fatty acid metal salt and the acid value polyethylene is injected into a mold. Moreover, the solid lubricant in a particulate form can be produced by granulating droplets of the mixed molten solution, or by spraying the mixed molten solution.

Use of the solid lubricant as a lubricant to an image bearing member after transfer in an electrophotographic image forming method makes it possible to suppress both the occurrence of image density unevenness and the cleaning failure. Hereinbelow, the reason will be described.

First of all, the solid lubricant comprises a fatty acid metal salt. The fatty acid metal salt is publicly known as a lubricant for image bearing members; however, when the fatty acid metal salt is used alone as a solid lubricant, the affinity to the surface of the image bearing member is insufficient in some cases. In more detail, the fatty acid metal salt is normally a compound comprising mainly an aliphatic alkyl group having 10 or more carbon atoms. However, the compound having an aliphatic alkyl group having 10 or more carbon atoms is not generally contained in the composition of the surface of the image bearing member. Accordingly, the adhesion and affinity of the fatty acid metal salt to the surface of the image bearing member are liable to be insufficient.

On the other hand, components left after transfer, such as toners or external additives thereof, are liable to be present more in a portion corresponding to an image portion having a higher coverage among images formed on the surface of the image bearing member. Thus, when the fatty acid metal salt is continuously applied as a lubricant to the portion where such components left after transfer are present more in the image bearing member, the application of the lubricant on the surface of the image bearing member is inhibited by the presence of the components left after transfer to make application unevenness of the lubricant liable to occur. When the application unevenness occurs in the application of the solid lubricant comprising a fatty acid metal salt alone, the following two problems occur in some cases.

The one is that once a portion where the thickness of application is insufficient is generated, the abrasion of a cleaning blade and the abrasion of the surface of the image bearing member associated with the abrasion of the cleaning blade are accelerated to increase the components left after transfer and passing through the cleaning blade, and as a result, the abrasion of the cleaning blade and of the image bearing member are further accelerated in some cases.

The other is that the fatty acid metal salt generally has a characteristic of becoming positively charged as compared with materials that constitute the surface of the image bearing member, and materials of the toner particles and carrier particles in developers. Thus, when the application unevenness is present, the charge amount in a lubricant film (lubricant layer) formed on the surface of the image bearing member by the application of the solid lubricant is different depending on the variation of thickness in the application unevenness. Accordingly, electric potential unevenness of the image bearing member occurs, and as a result, image density unevenness in a printed image occurs in some cases. Especially in the case where a halftone image in an intermediate density area is formed, the image density unevenness is more remarkable.

As described in the Description of Related Art, a melt molded product of a fatty acid metal salt and a hydrocarbon-based wax, such as a polyethylene not having an acid value, is known as the solid lubricant. The electrification characteristic of the hydrocarbon-based wax is weak, therefore the solid lubricant comprising the wax is effective for suppressing the occurrence of the image density unevenness and has a tendency that any of spreadability, applicability, and image unevenness is improved as compared with the case of the solid lubricant comprising a fatty acid metal salt alone.

However, the hydrocarbon-based wax generally has lower polarity and melting point as compared with fatty acid metal salts, and therefore mixing of the wax and the fatty acid metal salt in a molecular level is difficult. Thus, the solid lubricants obtained by the melt molding method are liable to have a sea-island structure, and it is difficult to resolve the application unevenness with the solid lubricant.

In addition, the solid lubricant comprising the hydrocarbon-based wax alone has insufficient spreadability and applicability, and has weak affinity and adhesion to image bearing members, and toners and external additives thereof, etc. as compared with the fatty acid metal salt. Thus, the solid lubricant of the hydrocarbon-based wax is liable to cause application failure and application unevenness, and as a result, prevention of cleaning failure becomes insufficient and the effect by the solid lubricant over a long period of time cannot be obtained in some cases.

The defect of the solid lubricant of the hydrocarbon-based wax is improved in the solid lubricant according to the present embodiments, and as a result, the solid lubricant according to the present embodiments is excellent in applicability to make it possible to prevent application unevenness irrespective of the amount of components left after transfer, and is effective for prevention of the image unevenness and prevention of the abrasion in the cleaning blade and in the image bearing member. The reason is considered to be as follows.

The acid value polyethylene has strong adhesion and affinity to the surface of the image bearing member as compared with the fatty acid metal salt. As the reason that the acid value polyethylene has high adhesion and affinity to the surface of the image bearing member, it is considered that the acid value polyethylene, when compared with the fatty acid metal salt, has a weak hydrophobicity and therefore has polarity closer to the polarity of the surface composition of the image bearing member.

Moreover, as the reason, it is considered that basic functional groups (such as, for example, amino groups in materials for a charge transport layer, and hydroxy groups in external additives adhered from toners to the surface of an image bearing member) are generally present on the surface of the image bearing member and the acid value polyethylene has a strong affinity to the basic functional groups. Thus, the applicability on the surface of the image bearing member is excellent, the application unevenness is prevented irrespective of the amount of the components left after transfer on the surface of the image bearing member, and the image density unevenness, the abrasion of the cleaning blade, and the abrasion of the image bearing member are suppressed.

Moreover, the acid value polyethylene, when compared with normal hydrocarbon-based waxes such as polyethylenes not having an acid value, has polarity closer to the polarity of the fatty acid metal salt. Thus, the acid value polyethylene is easily mixed with the fatty acid metal salt in a molecular level when molded by a method such as a melt molding method. Therefore, the defects of applicability and spreadability of the conventional solid lubricants comprising the polyethylene not having an acid value and the aliphatic metal salt are resolved in the solid lubricant. Therefore, the applicability on the surface of the image bearing member is excellent, application unevenness is prevented, and the image density unevenness, the abrasion of the cleaning blade, and the abrasion on the image bearing member are suppressed with the solid lubricant according to the present embodiments as compared with the case of the conventional solid lubricant.

As a result, the solid lubricant is stably applied on the surface of the image bearing member irrespective of the coverage (average density of image) and the amount of components passed through the cleaning blade on the image bearing member by applying the lubricant to an electrophotographic image formation method, and therefore, the application unevenness is prevented and the abrasion of the cleaning blade and the abrasion of the image bearing member are suppressed.

As clearly understood from the description above, the solid lubricant is a solid lubricant for forming a lubricant layer on the surface of an image bearing member of an image forming apparatus in electrophotography by being applied on the surface of the image bearing member, and comprises a fatty acid metal salt and a polyethylene having an acid value. Therefore, the occurrence of image density unevenness and cleaning failure can be suppressed in electrophotographic formation of an image.

It is advantageous that the polyethylene having an acid value has one or both of the carboxyl group and the carboxylic acid anhydride group or the polyethylene having an acid value has a structure of a copolymer of an acidic monomer and ethylene from the standpoint of the exhibition and adjustment of the acid value.

Moreover, it is further effective that the fatty acid metal salt is zinc stearate from the standpoint of enhancing compatibility of the fatty acid metal salt with the acid value polyethylene.

[Image Forming Apparatus]

The image forming apparatus according to the present embodiments comprises: a rotatable image bearing member; a charging device for charging the image bearing member; a transfer device for transferring a toner image born on a charged image bearing member to a toner receiving article; and a lubricant applying device for applying a lubricant on a surface of the image bearing member, the lubricant applying device being disposed in a rotational direction of the image bearing member between the transfer device and the charging device. The image forming apparatus can be configured in the same manner as in publicly known image forming apparatuses except the lubricant applying device.

The lubricant applying device comprises: the solid lubricant according to the present embodiments; a lubricant applying member that has flexibility and is to be disposed so as to abut freely onto the surface of the image bearing member; and a lubricant supplying device for supplying the solid lubricant to the lubricant applying member. The lubricant applying device can be configured in the same manner as in publicly known lubricant applying devices except that the solid lubricant according to the present embodiments is used as the solid lubricant.

Moreover, the image forming method according to the present embodiments comprises: charging an image bearing member; forming an electrostatic latent image on a charged image bearing member; supplying a toner to the image bearing member having the electrostatic latent image formed thereon, thereby allowing to bear a toner image on the image bearing member; transferring the toner image born on the image bearing member to a toner receiving article; and applying, on the surface of the image bearing member after transferring the toner image, a lubricant supplied from a solid lubricant, thereby forming a lubricant layer, and the solid lubricant according to the present embodiments is used as the solid lubricant. The image forming method according to the present embodiments can be conducted in the same manner as publicly known image forming methods in electrophotography except that the solid lubricant according to the present embodiments is used as the solid lubricant.

Hereinbelow, the image forming apparatus and image forming method according to the present embodiments will be described with reference to the appended drawings. Image forming apparatus 1 illustrated in FIG. 1 comprises image reading section 110, image processing section 30, image forming section 40, sheet conveying section 50, and fixing device 60.

Image forming section 40 comprises image forming units 41Y, 41M, 41C, 41K, each of which forms an image with each of color toners of Y (yellow), M (magenta), C (cyan), and K (black). These image forming units have the same configuration except the toner housed therein, and therefore the signs each representing the color are sometimes omitted. Image forming section 40 further comprises intermediate transfer unit 42 and secondary transfer unit 43, and these transfer units correspond to the transfer device.

Image forming unit 41 comprises exposing device 411, developing device 412, photoconductor drum 413, charging device 414, and cleaning device 415. Photoconductor drum 413 is, for example, a negative charge type organic photoconductor. The surface of photoconductor drum 413 has photoconductivity. Photoconductor drum 413 corresponds to the image bearing member.

Charging device 414 is, for example, a corona discharger. Charging device 414 may be a contact charging device that charges a contact charging member such as a charging roller, charging brush, or charging blade by making the contact charging member into contact with photoconductor drum 413. Exposing device 411 comprises, for example, a semiconductor laser as a light source and a light deflecting device (polygon motor) that deflects laser light according to the image to be formed toward photoconductor drum 413.

Developing device 412 is a two-component developing type developing device. Developing device 412 comprises, for example, a developer container that houses a two-component developer, a developing roller (magnetic roller) that is rotatably disposed at an opening of the developer container, a partition wall that partitions the inside of the developer container such that the two-component developer may be communicated, a conveyance roller that conveys the two-component developer on the opening side in the developer container toward the developing roller, and a stirring roller that stirs the two-component developer in the developer container. The toner as the two-component developer is housed in the developer container.

Intermediate transfer unit 42 comprises intermediate transfer belt 421, primary transfer roller 422 that presses intermediate transfer belt 421 to photoconductor drum 413, a plurality of supporting rollers 423 including backup roller 423A, and belt cleaning device 426. Intermediate transfer belt 421 is stretched into a loop shape with a plurality of supporting rollers 423. Rotation of at least one driving roller among a plurality of supporting rollers 423 allows intermediate transfer belt 421 to run at a constant speed in a direction of arrow mark A. Intermediate transfer belt 421 corresponds to the toner receiving article.

Secondary transfer unit 43 comprises endless secondary transfer belt 432 and a plurality of supporting rollers 431 including secondary transfer roller 431A. Secondary transfer belt 432 is stretched into a loop shape with secondary transfer roller 431A and supporting rollers 431.

Cleaning device 415 comprises cleaning container 415A that opens toward photoconductor drum 413 and cleaning blade 415B disposed at an opening of cleaning container 415A so as to abut onto the surface of photoconductor drum 413. Cleaning blade 415B is, for example, an elastic blade made of rubber.

Cleaning container 415A further comprises rotary brush 416A abutting onto the surface of photoconductor drum 413, solid lubricant 416B abutting onto the surface of rotary brush 416A, and biasing member 416C biasing solid lubricant 416B toward rotary brush 416A. Rotary brush 416A, solid lubricant 416B, and biasing member 416C are disposed in the rotational direction of the image bearing member between the transfer device and the charging device, and correspond to lubricant applying device for applying the lubricant on the surface of photoconductor drum 413.

Solid lubricant 416B is the solid lubricant according to the present embodiments. Solid lubricant 416B is manufactured by, for example, a melt molding method. The shape of solid lubricant 416B can appropriately be determined within a range where the solid lubricant is applicable on the surface of photoconductor drum 413 with the rotary brush, and is, for example, a rectangular parallelepiped having an equivalent length to the length of rotary brush 416A in the axial direction Rotary brush 416A is configured rotatably in the forward direction or the backward direction to photoconductor drum 413. Rotary brush 416A comprises, for example, a rotatable shaft made of metal and a plurality of hair materials made of a resin, the hair materials raised from a peripheral face of the shaft and having flexibility. Rotary brush 416A corresponds to the lubricant applying member that has flexibility and is to be disposed so as to abut freely onto the surface of the image bearing member.

Biasing member 416C is a member that biases and pushes solid lubricant 416B to rotary brush 416A, and is, for example, an elastic member, such as a coil spring and a plate spring. Biasing member 416C corresponds to the lubricant supplying device for supplying the solid lubricant to the lubricant applying member.

Fixing device 60 comprises, for example, fixing roller 62, endless heat generating belt 63 that covers an outer peripheral surface of fixing roller 62, and heats and melts the toners constituting toner images on sheet S, and pressure roller 64 that presses sheet S toward fixing roller 62 and heat generating belt 63. Sheet S corresponds to a recording medium.

Image forming apparatus 1 further comprises image reading section 110, image processing section 30, and sheet conveying section 50. Image reading section 110 comprises sheet feed device 111 and scanner 112. Sheet conveying section 50 comprises sheet feed section 51, sheet discharge section 52, and conveyance path section 53. Sheets S (specified sheets, special sheets) distinguished based on basis weight, size, etc. are housed in three sheet feed tray units 51*a* to 51*c* that configure sheet feed section 51 according to the kind that has been set in advance. Conveyance path section 53 comprises a plurality of conveyance roller pairs, such as registration roller pair 53*a*.

Formation of an image with image forming apparatus 1 will be described hereinbelow. The image forming method with image forming apparatus 1 comprises: charging photoconductor drum 413; forming an electrostatic latent image on charged image photoconductor drum 413; supplying a toner to photoconductor drum 413 having the electrostatic latent image formed thereon, thereby bearing the toner image on photoconductor drum 413; transferring the toner image born on photoconductor drum 413 to a toner receiving article; and applying, on the surface of photoconductor drum 413 after transferring the toner image, a lubricant supplied from solid lubricant 416B, thereby forming a lubricant layer.

First of all, scanner 112 optically scans and reads manuscript D on a contact glass. Reflected light from manuscript D is read with CCD sensor 112*a* to become input image data. The input image data is subjected to a predetermined image processing in image processing section 30 and is fed to exposing device 411.

Photoconductor drum 413 rotates at a constant circumferential speed. Charging device 414 evenly charges the surface of photoconductor drum 413 into a negative polarity. In exposing device 411, a polygon mirror of the polygon motor rotates at a high speed, the laser light corresponding to input image data of each color component develops along the axial direction of photoconductor drum 413, and the outer peripheral surface of photoconductor drum 413 is irradiated along the axial direction with the laser light. Thus, an electrostatic latent image is formed on the surface of photoconductor drum 413.

In developing device 412, toner particles are charged by stir and conveyance of the two-component developer in the developer container, and the two-component developer is conveyed to the developing roller to form a magnetic brush on the surface of the developing roller. The charged toner particles electrostatically adhere to an electrostatic latent image portion in photoconductor drum 413 from the magnetic brush. Thus, the electrostatic latent image on the surface of photoconductor drum 413 is visualized and a toner image according to the electrostatic latent image is formed on the surface of photoconductor drum 413.

The toner image on the surface of photoconductor drum 413 is transferred to intermediate transfer belt 421 with intermediate transfer unit 42. Intermediate transfer belt 421 is pressed to photoconductor drum 413 with primary transfer roller 422, thereby forming a primary transfer nip by photoconductor drum 413 and intermediate transfer belt 421 for every photoconductor drum 413. In the primary transfer nips, the toner images of respective colors are sequentially transferred and superimposed to intermediate transfer belt 421.

On the surface of photoconductor drum 413 after transfer, a fine particulate lubricant obtained by scraping solid lubricant 416B with rotary brush 416A to which solid lubricant 416B is pressed is supplied from rotary brush 416A, and is evenly applied.

The acid value polyethylene mixed with the fatty acid metal salt in a molecular level is contained in the lubricant, and the acid value polyethylene has a moderate polarity and has moderate adhesion and affinity to each of a composition on the surface of photoconductor drum 413, a composition that constitutes toners, and fatty acid metal salts. Accordingly, the lubricant evenly adheres to the surface of photoconductor drum 413 irrespective of the existence of the toners left after transfer or not.

The surface portion of photoconductor drum 413 where the lubricant has been applied reaches cleaning blade 415B. The toners left after transfer and excessive lubricant on the surface of photoconductor drum 413 are scraped off with cleaning blade 415B and housed in the container. Thus, the toners left after transfer are removed from the surface, and the lubricant is smoothened and spreads on the surface to form an even lubricant layer.

Moreover, the abrasion between cleaning blade 415B abutting onto the surface and the surface of photoconductor drum 413 is reduced in the whole of the direction of abutting length of cleaning blade 415B by the lubricant being applied on the surface. Accordingly, the abrasion of cleaning blade 415B is suppressed, and the abrasion on the surface of photoconductor drum 413 is also suppressed.

The surface of photoconductor drum 413 where the toners left after transfer are removed with cleaning device 415 and the lubricant layer having an even thickness is formed is charged again with charging device 414. Since the lubricant layer is evenly formed on the surface of photoconductor drum 413, the surface is evenly charged. Accordingly, image density unevenness associated with charge unevenness is prevented.

On the other hand, secondary transfer roller 431A is pressed to backup roller 423A through intermediate transfer belt 421 and secondary transfer belt 432. Thereby, intermediate transfer belt 421 and secondary transfer belt 432 form a secondary transfer nip. Sheet S passes through the secondary transfer nip. Sheet S is conveyed to the secondary transfer nip with sheet conveying section 50. The correction of tilt of sheet S and the adjustment of conveyance timing are conducted with a registration roller section where registration roller pair 53*a* is disposed.

When sheet S is conveyed to the secondary transfer nip, transfer bias is applied to secondary transfer roller 431A. The application of transfer bias allows the toner image born on intermediate transfer belt 421 is transferred to sheet S in the secondary transfer nip. Sheet S where the toner image has been transferred is conveyed toward fixing device 60 with secondary transfer belt 432.

Fixing device 60 forms fixing a nip with heat generating belt 63 and pressure roller 64, and heats and pressurizes, in the fixing nip section, sheet S that has been conveyed. Heating the toner particles constituting the toner image on sheet S promptly melt the whole toner particles, and toner components adhere to sheet S and are promptly solidified. Thus, the toner image is fixed to sheet S. Sheet S where the toner image has been fixed is discharged outside the machine with sheet discharge section 52 comprising sheet discharge roller 52*a*. Thus, a high quality image is formed.

In addition, the toners left after secondary transfer on the surface of intermediate transfer belt 421 are removed with belt cleaning device 426 comprising a belt cleaning blade that is in slide contact with the surface of intermediate transfer belt 421.

As clearly understood from the above description, image forming apparatus 1 comprises: rotatable photoconductor drum 413; charging device 414 for charging photoconductor drum 413; a transfer device for transferring a toner image born on charged photoconductor drum 413 to a toner receiving article; and a lubricant applying device for applying a lubricant on the surface of photoconductor drum 413, the lubricant applying device disposed in a rotational direction of photoconductor drum 413 between the transfer device and charging device 414. And the lubricant applying device comprises: solid lubricant 416B; rotary brush 416A that has flexibility and is to be disposed so as to abut freely onto the surface of photoconductor drum 413; and biasing member 416C for supplying solid lubricant 416B to rotary brush 416A.

Moreover, the image forming method comprises: charging photoconductor drum 413; forming an electrostatic latent image on charged photoconductor drum 413; supplying a toner onto photoconductor drum 413 having the electrostatic latent image formed thereon, thereby bearing a toner image on photoconductor drum 413; transferring the toner image born on photoconductor drum 413 to a toner receiving article; and applying, on the surface of photoconductor drum 413 after transferring the toner image, a lubricant supplied from solid lubricant 416B, thereby forming a lubricant layer. Accordingly, both of the image forming apparatus and the image forming method can suppress the occurrence of image density unevenness and cleaning failure.

Figure 2A:
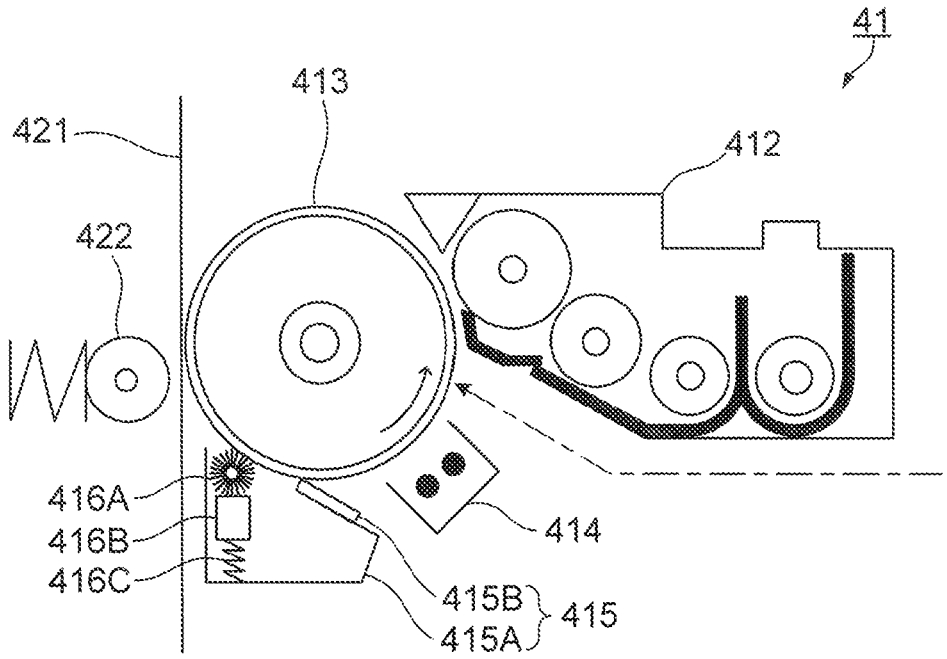
FIG. 2A is a diagram schematically illustrating a configuration of a lubricant applying device in an embodiment of the present invention.

In addition, image forming apparatus 1 is not limited to the configuration. For example, image forming apparatus 1 comprises the lubricant applying device in cleaning container 415A, however the lubricant applying device may be disposed independently from cleaning device 415. Moreover, the lubricant applying device may be disposed at a position between cleaning device 415 and charging device 414 as illustrated in FIG. 2B, or may be present at both of a position between the transfer device and cleaning device 415 as illustrated in FIG. 2A and a position between cleaning device 415 and charging device 414 as illustrated in FIG. 2B.

Figure 2B:
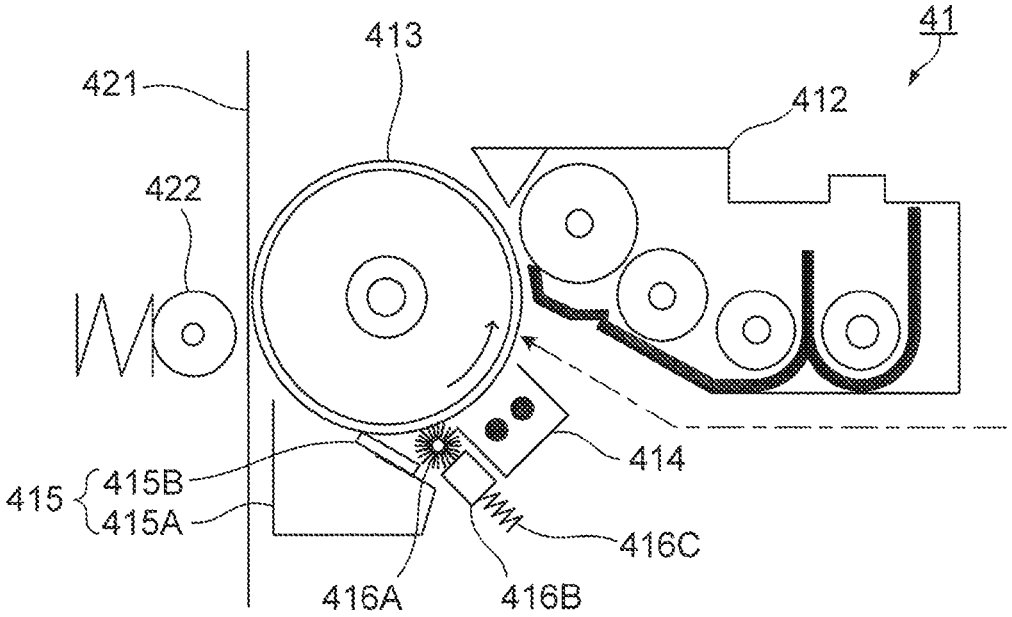
FIG. 2B is a diagram schematically illustrating a configuration of a lubricant applying device in another embodiment of the present invention.

Furthermore, the lubricant applying device, when disposed at the position illustrated in FIG. 2B, may further comprise a member that smoothen the applied lubricant, such as, for example, an elastic blade, an elastic brush, an elastic belt or an elastic roller that is disposed so as to abut onto the surface of photoconductor drum 413.

Moreover, rotary brush 416A may be another applying member to which a lubricant can be supplied from solid lubricant 416B, such as an elastic belt or an elastic roller that abuts onto the surface of photoconductor drum 413, the another applying member capable of applying the lubricant on the surface of photoconductor drum 413. Further, any of rotary brush 416A and another applying member may be disposed so as to abut onto the surface of photoconductor drum 413 only during application.

Moreover, solid lubricant 416B is a lump of rectangular parallelepiped that is integrally molded, but may take any form as long as the solid lubricant is applicable on the surface of photoconductor drum 413, and, for example, solid lubricant 416B may be a particulate solid lubricant that is housed in a container. Furthermore, the lubricant supplying device may take any form according to the form of the solid lubricant, and, for example, in the case where the solid lubricant is a particle, the lubricant supplying device may be a container that houses the solid lubricant particle so that the solid lubricant particle may be supplied to a lubricant applying member, such as a rotary brush.

As clearly understood from the above description, the occurrence of image density unevenness and cleaning failure in the formation of an image in electrophotography can be suppressed according to the present embodiments.

EXAMPLES

The present invention will be described further specifically with reference to Examples and Comparative Examples below. In addition, the present invention is not limited to the following Examples.

[Polyethylene]

Polyethylenes 1 to 9 described in Table 1 below were prepared. In Table 1, "PE" represents "polyethylene". "Licowax" is a registered trademark of Clariant International Ltd. "A-C" is a registered trademark of Honeywell International Inc. "Hi-WAX" is a trademark of Mitsui Chemicals Inc. Moreover, in Table 1, "Company M" represents Mitsui Chemicals Inc., "Company C" represents Clariant (Japan) K.K., and "Company H" represents Honeywell Japan Inc. The acid value is a catalogue value or a measured value. The measured value of the acid value is determined according to the method described in JIS K0070.

TABLE 1

| PE No. | Name | Manufacturer | Kind of resin | Acid value (mgKOH/g) |
|---|---|---|---|---|
| 1 | Hi-WAX 4051E | Company M | Oxidized PE | 12 |
| 2 | Hi-WAX 4202E | Company M | Oxidized PE | 17 |

TABLE 1-continued

| PE No. | Name | Manu-facturer | Kind of resin | Acid value (mgKOH/g) |
|---|---|---|---|---|
| 3 | Hi-WAX 210MP | Company M | Oxidized PE | 1 |
| 4 | Hi-WAX 2203A | Company M | Acid modified PE | 30 |
| 5 | Hi-WAX 1105A | Company M | Acid modified PE | 60 |
| 6 | Licowax PED 121 | Company C | Oxidized PE | 16 to 19 |
| 7 | A-C 673P | Company H | Oxidized PE | 17 |
| 8 | A-C 395 | Company H | Oxidized PE | 41 |
| 9 | Hi-WAX NP055 | Company M | PE | 0 |

Example 1

A dried powder of 99.5 parts by weight of zinc stearate and 0.5 parts by weight of polyethylene 1 was housed in a container and mixed at room temperature (25° C.), and then the temperature in the container was raised to 150° C. to melt the dried powder in the container completely. Subsequently, the material was stirred and mixed at the above-described temperature for 30 minutes to obtain a molten material.

Subsequently, the molten material was injected carefully not to lower the temperature of the material to 145° C. or lower in the middle of injection into a mold the internal temperature of which was raised to 150° C. in advance, and the mold was left to stand for 30 minutes while holding the temperature in the mold at 150° C. Subsequently, the mold was cooled to room temperature (25° C.) at a rate of 1° C./min carefully not to cause temperature variation, and a solid body of a melt molding product of the material was taken out from the molding to obtain solid lubricant 1 having a size of 8 mm×11 mm×328 mm.

Examples 2 to 6

Solid lubricants 2 to 6 were obtained in the same manner as in Example 1 except that the amount of zinc stearate was changed to 99.0, 95.0, 90.0, 70.0, and 50.0 parts by weight, respectively, and the amount of polyethylene 1 was changed to 1.0, 5.0, 10.0, 30.0, and 50.0 parts by weight, respectively.

Examples 7 to 13

Solid lubricants 7 to 13 were obtained in the same manner as in Example 3 except that polyethylene 2 to 8 were used, respectively, in place of polyethylene 1.

Examples 14 and 15

Solid lubricant 14 was obtained in the same manner as in Example 3 except that zinc myristate was used in place of zinc stearate. Moreover, solid lubricant 15 was obtained in the same manner as in Example 7 except that magnesium stearate was used in place of zinc stearate.

Comparative Examples 1 and 3

Solid lubricants 16 and 18 were obtained in the same manner as in Examples 3 and 14, respectively, except that polyethylene 9 was used in place of polyethylene 1.

Comparative Examples 2, 4, and 5

Solid lubricants 17, 19, and 20 were obtained in the same manner as in Examples 3, 14, and 15, respectively, except that polyethylenes 1 and 2 were not used.

Materials and compositions thereof for solid lubricants 1 to 20 are shown in Table 2. In Table 2, "Zn stearate", "Zn myristate", and "Mg stearate" represent "zinc stearate", "zinc myristate", and "magnesium stearate", respectively.

TABLE 2

| | | Fatty acid metal salt | | Polyethylene | | |
|---|---|---|---|---|---|---|
| | Solid lubricant No. | Kind | Content (parts by weight) | Number | Acid value (mgKOH/g) | Content (parts by weight) |
| Example 1 | 1 | Zn stearate | 99.5 | 1 | 12 | 0.5 |
| Example 2 | 2 | Zn stearate | 99 | 1 | 12 | 1 |
| Example 3 | 3 | Zn stearate | 95 | 1 | 12 | 5 |
| Example 4 | 4 | Zn stearate | 90 | 1 | 12 | 10 |
| Example 5 | 5 | Zn stearate | 70 | 1 | 12 | 30 |
| Example 6 | 6 | Zn stearate | 50 | 1 | 12 | 50 |
| Example 7 | 7 | Zn stearate | 95 | 2 | 17 | 5 |
| Example 8 | 8 | Zn stearate | 95 | 3 | 1 | 5 |
| Example 9 | 9 | Zn stearate | 95 | 4 | 30 | 5 |
| Example 10 | 10 | Zn stearate | 95 | 5 | 60 | 5 |
| Example 11 | 11 | Zn stearate | 95 | 6 | 16 to 19 | 5 |
| Example 12 | 12 | Zn stearate | 95 | 7 | 17 | 5 |
| Example 13 | 13 | Zn stearate | 95 | 8 | 41 | 5 |
| Example 14 | 14 | Zn myristate | 95 | 1 | 12 | 5 |
| Example 15 | 15 | Mg stearate | 95 | 2 | 17 | 5 |
| Comparative Example 1 | 16 | Zn stearate | 95 | 9 | 0 | 5 |
| Comparative Example 2 | 17 | Zn stearate | 100 | — | — | 0 |
| Comparative Example 3 | 18 | Zn myristate | 95 | 9 | 0 | 5 |
| Comparative Example 4 | 19 | Zn myristate | 100 | — | — | 0 |
| Comparative Example 5 | 20 | Mg stearate | 100 | — | — | 0 |

[Formation of Image and Evaluation of Solid Lubricants]

Drum units 1 to 20 were set up using solid lubricants 1 to 20, respectively, in place of a solid lubricant provided in drum units of a commercially available image forming apparatus "bizhub PRESS C1100" (manufactured by Konica Minolta, Inc., and "bizhub" is a trademark of the company). And, a driving gear for an application brush mounted on each of drum units 1 to 20 was adjusted so that the scraping rate of each of solid lubricants 1 to 20 was 5 mg/min under the normal paper printing condition at 10° C. in a relative humidity of 20% (LL environment). And then, each of drum units 1 to 20 was mounted on the image forming apparatus as a cyan image forming unit to prepare image forming apparatuses 1 to 20 having solid lubricants 1 to 20, respectively.

Image forming apparatuses 1 to 20 were turned on to conduct initial stabilization operation at 10° C. in a relative humidity of 20% (LL environment), and then 2,000 prints of a test image were continuously formed on A3 normal paper with each of image forming apparatuses 1 to 20. The test image includes: a 100% solid image portion (hereinafter, also referred to as "solid image portion") of cyan, the image portion formed on the central portion in the width direction of the normal paper over the whole length of the normal paper; and non-image portions (white paper portions) disposed at both sides of the 100% solid image portion. J paper (manufactured by Konica Minolta Business Solutions, Inc.) was used as the normal paper. In addition, the width of the solid image portion in the test image and the width of respective non-image portions are the same (⅓ of paper width).

[Image Density Unevenness]

Immediately after forming the test images, one print of each of green images 1 and 2 described below and composed of a yellow toner and a cyan toner was formed, i.e. two prints in total, on POD Gloss Coat paper (manufactured by Oji Paper Co., Ltd.). As a yellow image forming unit, new and regular drum unit in the commercially available image forming apparatus was used.

Basis weight of POD Gloss Coat paper: 128 g/m$^2$

Image 1: 40% halftone image (image density: 40% of yellow and 40% of cyan)

Image 2: 100% solid image (image density: 100% of yellow and 100% of cyan)

Whether the image density unevenness was seen on the portion corresponding to the boundary between the solid image portion and the white paper portion in the test image was checked for images 1 and 2 in the two prints, and evaluated according to the following criteria to give scores. In addition, the check of the image density unevenness was conducted on each of the two portions each corresponding to the boundary in the test image, and the average value of the two portions was evaluated according to the following criteria.

(Criteria)

Score 5: Image density unevenness is not seen at all.

Score 4: A streak is seen on the portion corresponding to the boundary when the portion is to carefully observed and image density difference is vaguely seen on a part of the portion.

Score 3: A streak is seen and image density difference is seen on the whole area of the portion corresponding to the boundary between the solid image portion and the white paper portion in the test image.

Score 2: A streak is seen and moreover, image density difference is observed at a level that the image density difference is easily detectable even when the measurement of reflection density is conducted with a Macbeth densitometer on the whole area of the portion corresponding to the boundary between the solid image portion and the white paper portion in the test image.

Score 1: A streak is seen, moreover, image density difference is clearly observed at a level that the image density difference is easily detectable even when the measurement of reflection density is conducted with a Macbeth densitometer on the whole area of the portion corresponding to the boundary between the solid image portion and the white paper portion in the test image.

[Filming Defect]

The number of defects due to filming was visually checked in images 1 and 2 to determine the total number of the defects in both images 1 and 2. It is to be noted that the defect due to filming is a defect on the surface of a photoconductor, the defect caused by, as a nucleus, burying of an external additive for a toner. The defect due to filming is considered to be a defect that occurs at a very early stage of abrasion of a photoconductor.

[Thickness of Lubricant]

The thickness of the lubricant layer of the photoconductor whose rotary drive was stopped after forming images 1 and 2 were measured by depth profile analysis of photoelectron spectroscopy (XPS). The thickness of the lubricant layer was measured at three points each in the portion between the toner image transfer position and the cleaning position with the cleaning blade in the rotational direction of the stopped photoconductor for each of the portion corresponding to the solid image portion in the test image and the portions corresponding to the white paper portions on both sides of the solid image portion in the test image.

The thickness of the lubricant layer was defined as the depth from the surface of the photoconductor to the position where a metal (zinc or magnesium) peculiar to each fatty acid metal salt of solid lubricants 1 to 20 was not detected. The thickness $T_2$ of the lubricant layer at the portion corresponding to the solid image portion was determined as the average value of three measured values, and the thickness $T_1$ of the lubricant layer at the portion corresponding to the white paper portion was determined as the average value of the measured values in two white paper portions, i.e. six measured values in total. And the difference between the two $\Delta T$ ($=T_1-T_2$) was determined. When $T_1$ or $T_2$ is 4 nm or more and $\Delta T$ is 2 nm or less, the thickness of the lubricant layer can be regarded as acceptable from the practical standpoint.

[Abrasion of Cleaning Blade]

Figure 3:
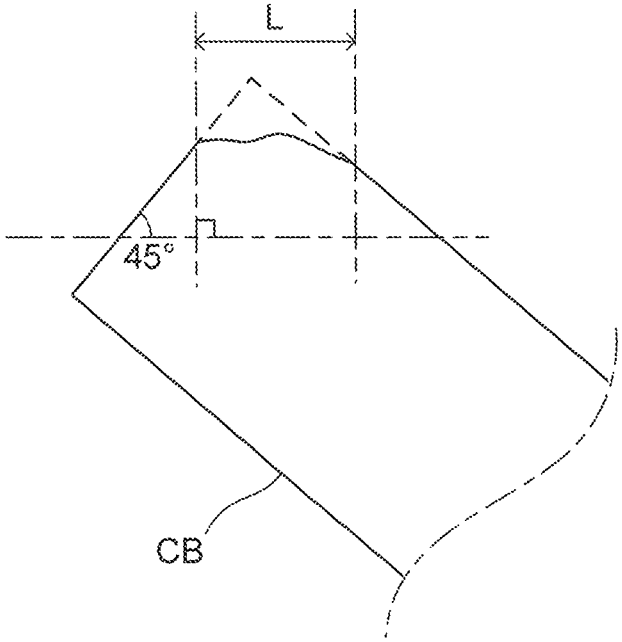
FIG. 3 is a diagram for describing an abrasion length of a cleaning blade.

The portion of the cleaning blade corresponding to the solid image portion in the test image after forming 2,000 prints of the test image was observed by a laser microscope to determine the abrasion length L, thereby evaluating the abrasion of the cleaning blade according to the following criteria. It is to be noted that the abrasion length L is, as illustrated in FIG. 3, a distance between boundaries of the surface of the blade tip and the portion nicked due to abrasion of the blade in a parallel direction to a reference line defined as a line intersecting with the surface of the blade tip at an angle of 45° in a longitudinal cross section of cleaning blade CB. When abrasion length L is "A" or "B", the abrasion of the cleaning blade can be regarded as acceptable from the practical standpoint.

(Criteria)

A: Abrasion length L is less than 1 μm

B: Abrasion length L is 1 μm or more and less than 2 μm

C: Abrasion length L is 2 μm or more and less than 4 μm

D: Abrasion length L is 4 μm or more and less than 6 μm

E: Abrasion length L is 6 μm or more

Evaluation results are described in Table 3. In Table 3, "40% HI" represents a 40% halftone image, "100% SI" represents a 100% solid image, and "FD" represents a filming defect. Moreover, "L" represents abrasion length.

TABLE 3

| | Image density unevenness | | | Thickness of lubricant | | | Abrasion of cleaning blade | |
|---|---|---|---|---|---|---|---|---|
| | 40% HI (score) | 100% SI (score) | Number of FD (number) | $T_1$ (nm) | $T_2$ (nm) | ΔT (nm) | L (μm) | Evaluation |
| Example 1 | 4.0 | 5.0 | 1 | 7.0 | 5.2 | 1.8 | 1.7 | B |
| Example 2 | 4.0 | 5.0 | 0 | 7.1 | 5.9 | 1.2 | 1.1 | B |
| Example 3 | 5.0 | 5.0 | 0 | 7.0 | 6.6 | 0.4 | 0.5 | A |
| Example 4 | 5.0 | 5.0 | 0 | 6.8 | 6.3 | 0.5 | 0.5 | A |
| Example 5 | 4.5 | 4.5 | 1 | 6.3 | 5.5 | 0.8 | 0.9 | A |
| Example 6 | 4.5 | 4.5 | 1 | 6.3 | 4.9 | 1.4 | 1.8 | B |
| Example 7 | 5.0 | 5.0 | 0 | 6.9 | 6.4 | 0.5 | 0.5 | A |
| Example 8 | 4.0 | 5.0 | 0 | 7.0 | 5.8 | 1.2 | 1.8 | B |
| Example 9 | 5.0 | 5.0 | 0 | 6.7 | 6.2 | 0.5 | 0.6 | A |
| Example 10 | 4.5 | 4.0 | 0 | 6.5 | 5.6 | 0.9 | 1.2 | B |
| Example 11 | 5.0 | 5.0 | 0 | 6.8 | 6.2 | 0.6 | 0.6 | A |
| Example 12 | 5.0 | 5.0 | 0 | 6.7 | 6.2 | 0.5 | 0.6 | A |
| Example 13 | 5.0 | 5.0 | 0 | 6.8 | 6.4 | 0.4 | 0.5 | A |
| Example 14 | 5.0 | 5.0 | 0 | 6.8 | 6.3 | 0.5 | 0.5 | A |
| Example 15 | 5.0 | 5.0 | 0 | 6.6 | 6.0 | 0.6 | 0.7 | A |
| Comparative Example 1 | 2.0 | 4.5 | 53 | 5.3 | 1.2 | 4.1 | 6.6 | E |
| Comparative Example 2 | 1.0 | 5.0 | 7 | 7.3 | 3.0 | 4.3 | 4.3 | D |
| Comparative Example 3 | 2.0 | 4.5 | 58 | 5.4 | 1.0 | 4.4 | 6.6 | E |
| Comparative Example 4 | 1.0 | 5.0 | 8 | 7.0 | 2.7 | 4.3 | 4.7 | D |
| Comparative Example 5 | 1.0 | 5.0 | 8 | 6.9 | 2.5 | 4.4 | 4.8 | D |

As clearly understood from Table 3, the thickness of the lubricant layer is sufficiently thick, as thick as 4 nm or more, irrespective of the white paper portion and the solid image portion and the difference ΔT in thickness of the lubricant layer of the white paper portion and the solid image portion is sufficiently small, as small as 2 nm or less in any of Examples 1 to 15. Accordingly, the cleaning function is sufficiently maintained, the abrasion of the cleaning blade is small and is in a favorable range, and filming of the photoconductor does not progress in any of image forming apparatuses 1 to 15 of Examples 1 to 15. Furthermore, the evaluation results on the image density unevenness are also favorable in image forming apparatuses 1 to 15 because the ΔT values are sufficiently small.

On the other hand, the thickness $T_2$ of the lubricant layer at the portion corresponding to the solid image portion is less than 4 nm and ΔT is large, as large as 4 nm or more, in any of Comparative Examples 1 to 5. Accordingly, the maintenance of the cleaning function is insufficient, and therefore the deterioration of the surface of the photoconductor progresses fast, the abrasion of the cleaning blade is large, and filming defect of a photoconductor frequently occurs in any of image forming apparatuses 16 to 20 of Comparative Examples 1 to 5. Furthermore, evaluation results of image density unevenness in the 40% halftone image were poor in image forming apparatuses 16 to 20. The reason is considered as follows: the ΔT values are large, as large as 4 nm or more, in image forming apparatuses 16 to 20 and therefore electric potential differences of the portion corresponding to the white paper portion and the portion corresponding to the solid image portion in the photoconductor become larger.

Especially in image forming apparatuses 16 and 18 (Comparative Examples 1 and 3) including solid lubricants 16 and 18, respectively, the solid lubricants each comprising polyethylene 9, the evaluation of abrasion length L of the cleaning blade is low, the thickness $T_2$ of the lubricant layer at the portion in the photoconductor corresponding to the solid image portion is small, and therefore filming defect remarkably occurs. It is considered that the reason is the polyethylene does not have an acid value and therefore the applicability of the fatty acid metal salt on the surface of the photoconductor is inhibited.

INDUSTRIAL APPLICABILITY

According to the present invention, a solid lubricant layer can be formed in an even thickness irrespective of high or low coverage of an image to be formed on the surface of a photoconductor where charge, development, and transfer are repeatedly conducted. Consequently, according to the present invention, a high quality image irrespective of image history can be formed stably, and further spread and development of image formation technology in electrophotography are expected.

What is claimed is:

1. An image forming apparatus comprising:

a rotatable image bearing member;

a charging device for charging the image bearing member;

a transfer device for transferring a toner image born on the charged image bearing member to a toner receiving article; and a lubricant applying device for applying a lubricant on a surface of the image bearing member, the lubricant applying device being disposed between the transfer device and the charging device in a rotational direction of the image bearing member, wherein the lubricant applying device comprises:

a solid lubricant comprising a fatty acid metal salt, and a polyethylene having an acid value;

a lubricant applying member that has flexibility and is to be disposed so as to abut freely on the surface of the image bearing member; and a lubricant supplying device for supplying the solid lubricant to the lubricant applying member.

2. The solid lubricant according to claim 1, wherein the polyethylene having an acid value has one or both of a carboxyl group and a carboxylic acid anhydride group.

3. The solid lubricant according to claim 1, wherein the polyethylene having an acid value has a structure of a copolymer of an acidic monomer and ethylene.

4. The solid lubricant according to claim 1, wherein the fatty acid metal salt is zinc stearate.

5. An image forming method comprising:

charging an image bearing member;

forming an electrostatic latent image on a charged image bearing member;

supplying a toner onto the image bearing member having an electrostatic latent image formed thereon, thereby allowing to bear the toner image on the image bearing member;

transferring the toner image born on the image bearing member to a toner receiving article; and applying, on the surface of the image bearing member after transferring the toner image, a lubricant supplied from a solid lubricant, thereby forming a lubricant layer, wherein the solid lubricant comprising a fatty acid metal salt, and a polyethylene having an acid value, is used as the solid lubricant.

6. The solid lubricant according to claim 5, wherein the polyethylene having an acid value has one or both of a carboxyl group and a carboxylic acid anhydride group.

7. The solid lubricant according to claim 5, wherein the polyethylene having an acid value has a structure of a copolymer of an acidic monomer and ethylene.

8. The solid lubricant according to claim 5, wherein the fatty acid metal salt is zinc stearate.

* * * * *